US011635081B2

(12) United States Patent
Norwood et al.

(10) Patent No.: US 11,635,081 B2
(45) Date of Patent: Apr. 25, 2023

(54) CEILING FAN BLADE

(71) Applicant: Hunter Fan Company, Memphis, TN (US)

(72) Inventors: Bobby Neal Norwood, Oakland, TN (US); Charles William Botkin, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 16/940,624

(22) Filed: Jul. 28, 2020

(65) Prior Publication Data

US 2022/0034329 A1 Feb. 3, 2022

(51) Int. Cl.
*F04D 25/08* (2006.01)
*F04D 29/38* (2006.01)
*F04D 29/34* (2006.01)

(52) U.S. Cl.
CPC ..... *F04D 25/088* (2013.01); *F04D 29/34* (2013.01); *F04D 29/388* (2013.01)

(58) Field of Classification Search
CPC ..... F04D 25/088
See application file for complete search history.

(56) References Cited

U.S. PATENT DOCUMENTS 2,283,956 A * 5/1942 Smith ..... B63H 1/26 416/223 R
2,918,977 A 12/1959 Fedan et al.
6,685,436 B2 * 2/2004 Huang ..... F04D 25/088 416/228
D594,551 S 6/2009 Parker et al.
D597,198 S 7/2009 Parker et al.
7,665,967 B1 2/2010 Parker et al.
D615,183 S 5/2010 Parker et al.
7,927,071 B2 4/2011 Parker et al.
D712,533 S 9/2014 Allen et al.
D801,516 S 10/2017 Wang
D804,648 S 12/2017 McRoberts
9,982,679 B2 5/2018 Santolucito et al.
10,273,964 B2 * 4/2019 Niemiec ..... F04D 25/088
10,493,411 B2 * 12/2019 Keller ..... B01F 7/00016
2007/0122286 A1 * 5/2007 Leung ..... F04D 29/384 416/210 R
2007/0154315 A1 * 7/2007 Bucher ..... F04D 29/384 416/210 R
2009/0263254 A1 * 10/2009 Bucher ..... F04D 29/023 416/229 R
2010/0054947 A1 * 3/2010 Chen ..... F04D 29/38 416/223 R

* cited by examiner

*Primary Examiner* — Courtney D Heinle
*Assistant Examiner* — John S Hunter, Jr.
(74) *Attorney, Agent, or Firm* — McGarry Bair PC

(57) ABSTRACT

A ceiling fan or similar air-moving device can include a motor for rotating one or more blades to drive a volume of air about a space. The blade can include a body having an outer surface with a flat top surface and a flat bottom surface, and a side edge. A chamfered transition can extend between one of the flat top surface or the flat bottom surface, and the side edge. The chamfered transition can include multiple chamfered edges.

15 Claims, 3 Drawing Sheets

CEILING FAN BLADE

TECHNICAL FIELD

The disclosure relates to ceiling fans, and more particularly, to blades for ceiling fans and a chamfered edge for a ceiling fan blade.

BACKGROUND

Ceiling fans are machines typically suspended from a structure for moving a volume of air about an area. The ceiling fan includes a motor, with a rotor and stator, suspended from and electrically coupled to the structure. A set of blades mount to the rotor such that the blades are rotatably driven by the rotor and can be provided at an angled orientation to move a volume of air about the area. As the cost of energy becomes increasingly important, there is a need to improve the efficiency at which the ceiling fans operate.

BRIEF DESCRIPTION

The disclosure relates to a blade for a ceiling fan with a motor for driving the blade which includes an outer surface with a top surface, side edge and a bottom surface, extending between a root and a tip in a span-wise direction, and extending from a first side to a second side in a chord-wise direction. The side edge further includes a first chamfered surface extending along the first side of the blade and a second chamfered surface, adjacent the first chamfered surface, extending along the first chamfered surface.

In another aspect, the disclosure relates to a blade for a ceiling fan, the blade extending between a first side edge and a second side edge defining a chordwise direction, the blade comprising: a flat upper surface; a flat lower surface opposite from the flat upper surface; a side edge spacing the flat upper surface and the flat lower surface; and a first chamfered surface extending along and meeting a second chamfered surface along the first side, wherein the first chamfered surface and the second chamfered surface define the side edge.

DETAILED DESCRIPTION

Figure 1:
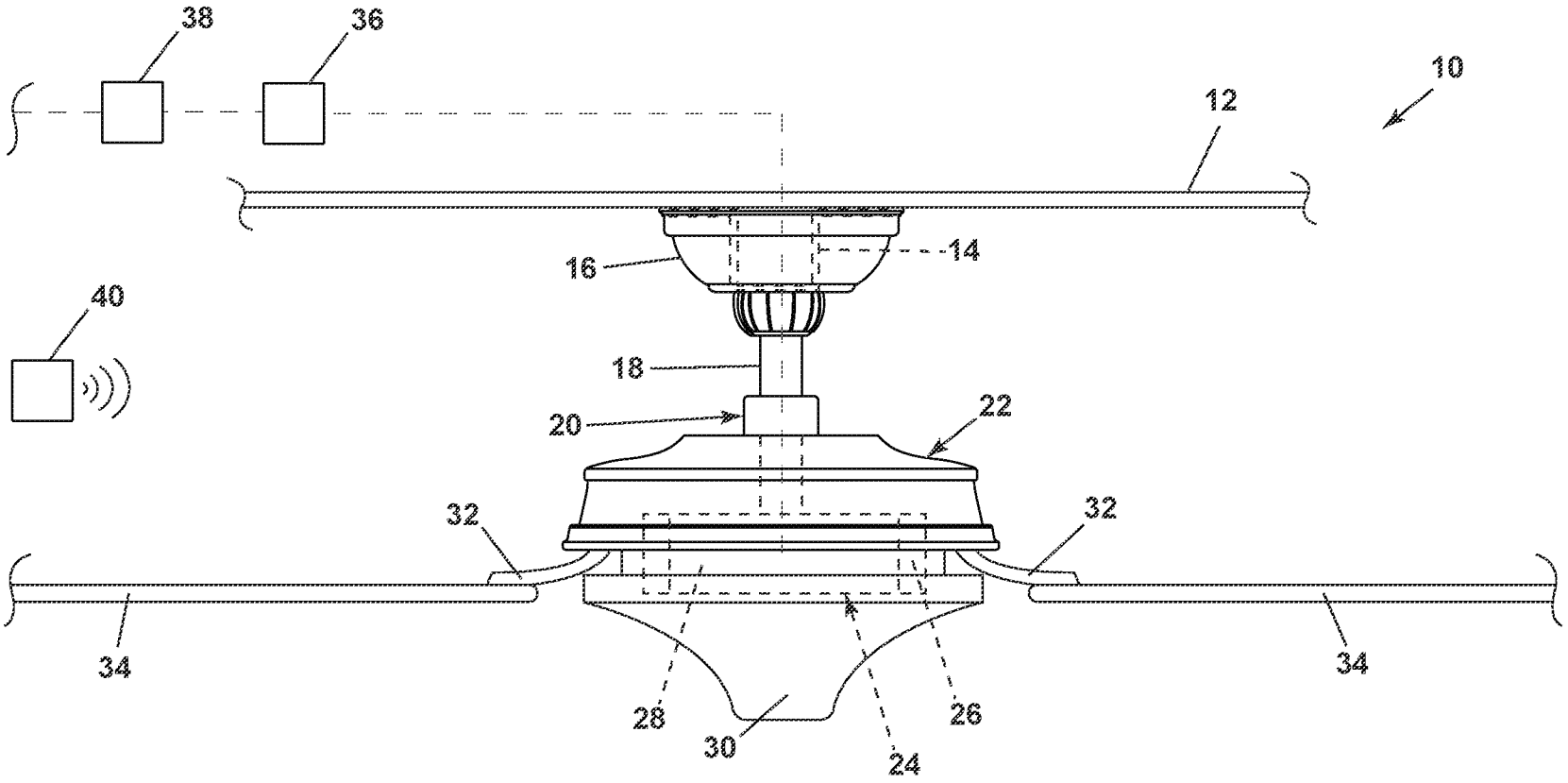
FIG. 1 is a schematic view of a structure with a ceiling fan suspended from a structure and including a set of blades.

The disclosure is related to a ceiling fan and ceiling fan blade, which can be used, for example, in residential and commercial applications. Such applications can be indoors, outdoors, or both. While this description is primarily directed toward a residential ceiling fan, it is also applicable to any environment utilizing fans, ceiling fans, or for cooling areas utilizing air movement or convective cooling.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket 14, canopy 16, a downrod 18, a motor adapter 20, a motor housing 22 at least partially encasing a motor 24 having a rotor 26 and a stator 28, a light kit 30, and a set of blade irons 32. In additional non-limiting examples, the ceiling fan 10 can include one or more of a controller, a wireless receiver, a ball mount, a hanger ball, a light glass, a light cage, a spindle, a finial, a switch housing, blade forks, blade tips or blade caps, or other ceiling fan components. A set of blades 34 can extend radially from the ceiling fan 10, and can be rotatable to drive a volume of air. The blades 34 can be operably coupled to the motor 24 at the rotor 26, such as via the blade irons 32. The blades 34 can include a set of blades 34, having any number of blades, including only one blade.

The structure 12 can be a ceiling, for example, from which the ceiling fan 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 36 and can electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A controller 38 can be electrically coupled to the electrical supply 36 to control operation of the ceiling fan 10 via the electrical supply 36. Alternatively, the controller 38 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 40, alone or in addition to the wired controller 38, can be communicatively coupled to a controller or a wireless receiver in the ceiling fan 10 to control operation of the ceiling fan 10. It is further contemplated in one alternative example that the ceiling fan be operated by the wireless controller 40 alone, and is not operably coupled with the wired controller 38.

Figure 2:
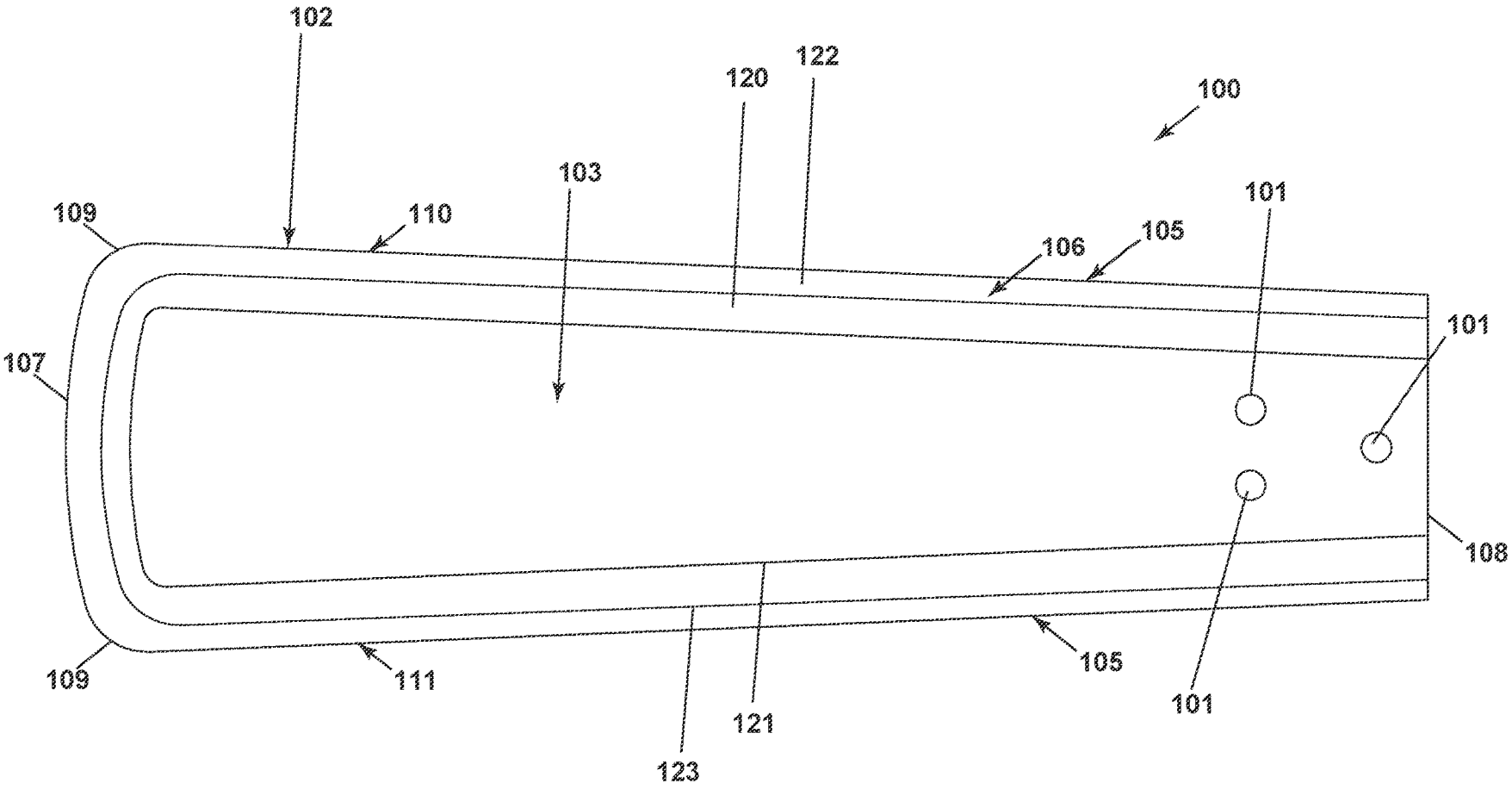
FIG. 2 is a top view of one blade from the set of blades of FIG. 1 having a chamfered surface transitioning to an edge of the blades.

Referring to FIG. 2, one blade 100 is isolated from the remainder of the fan 10 of FIG. 1 for illustration. Three fastener apertures 101 are provided in the blade 100 for fastening the blade to the motor 24 for rotating the blade 100 about the fan 10, preferably via the blade iron 32. Any number of fastener apertures or indeed any blade-attachment method or mechanism is within the scope of this disclosure. The blade 100 includes an outer surface 102 including a top surface 103 and a bottom surface 104 (see FIG. 3), and a side edge 105. A transition area 106 is included in the top surface 103 adjacent to the side edge 105.

The blade 100 further includes a tip 107 and a root 108, with the root 108 adjacent the fastener apertures 101 and the tip 107 opposite the root 108. Curved corners 109 transition between the tip 107 and the side edge 105, while it should be appreciated that the curved corners 109 can be optional or can include other shapes, such as sharp corners, for example. In another example, the transition area 106 need not extend along the tip 107 as currently shown, but can terminate at the tip 107 similar to that of the root 108. In yet another example, the root 108 can also include the transition area 106.

A chord-wise direction can be defined between the opposing side edges 105 and a span-wise direction can be defined between the tip 107 and the root 108. The blade 100 can widen extending from the root 108 to the tip 107 in the span-wise direction, defined in the chord-wise direction, while any top-down shape for the blade 100 is contemplated, such as having a thinning chord-wise width defined in the span-wise direction extending outwardly. Non-limiting examples of blade shapes can include squared, rectangular, curved, angled, or rounded, or any combination thereof.

Furthermore, the blade 100 can include a first edge 110 and a second edge 111 as the side edge 105 extends around the exterior of the blade 100, which can be arranged as a leading edge and a trailing edge, respectively, while the particular arrangement or nomenclature can vary based upon a rotational direction of the blade. The chord-wise direction can thus be defined between the first edge 110 and the second edge 111, defining a blade chord. As is appreciable, the blade chord as illustrated increases from the root 108 toward the tip 107.

Further still, the transition area 106 can extend along the entirety of the first edge 110, the second edge 111, the tip 107, and the root 108. As shown, the transition area 106 extends along the first and second edges 110, 111 and the tip 107, curving at the corners 109 where the first and second edges 110, 111 meet the tip 107.

The top surface 103 can include a flat top surface 116 adjacent the transition area 106. Alternatively, the top surface 103 need not be flat, but can include alternative geometries extending to the transition area 106, such as rounded or curved. In one example, the thickness or width of the transition area 106 can be about one inch between the top surface 103 and the side edge 105, while any width is contemplated. In another example, the transition area 106 can extend between 5%-40% of the chord-wise width of the blade 100 between the opposing side edges 105, while distances less than 5% or greater than 40% are contemplated.

As shown in FIG. 2, the transition area 106 includes at least two chamfered edges, for example, as a first chamfered edge 120 and a second chamfered edge 122. As shown, the first chamfered edge 120 spans a first transition vertex 121 and a second vertex 123. The second chamfered edge 122 extends between the second vertex 123 and the side edge 105. The first chamfered edge 120 and second chamfered edge 122 are included in the transition area 106 and are delimited by the side edge 105 and the first transition vertex 121. It is contemplated that the first transition vertex 121 provides a transitional junction between the flat top surface 116 and the first chamfered edge 120. Similarly, the second vertex 123 provides a transitional junction between the first chamfered edge 120 and the second chamfered edge 122. The second chamfered edge 122 transitions to the bottom surface 104 at the side edge 105.

As shown, the first chamfered edge 120 and second chamfered edge 122 can be provided at both the first edge 110 and the second edge 111. In one example, the first chamfered edge 120 can extend around the blade 100 continuously along the first edge 110, the tip 107, and the second edge 111, while it is contemplated that any of, or one or more portions of the root 108, the tip 107, the first edge 110, and the second edge 111 includes the first and second chamfered edges 120, 122.

Figure 3:
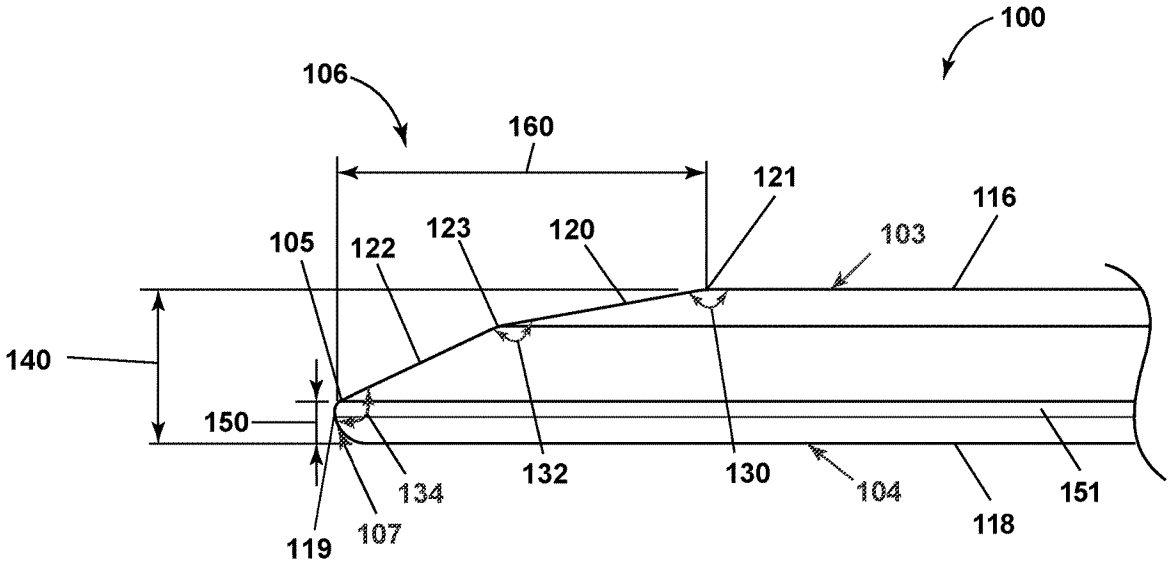
FIG. 3 is a sectional view of an exemplary blade illustrating two chamfered surfaces taken perpendicular to II of FIG. 2.

Referring to FIG. 3, a blade 100 is shown in cross-sectional profile. The first chamfered edge 120 defines a generally planar surface which extends between the flat top surface 116 and the second chamfered edge 122. The first chamfered edge 120 is located within the transition area 106 between the first transition vertex 121 and the second vertex 123. The first chamfered edge 120 is offset from the top surface 116 by a first angle 130 defined by the first transition vertex 121. In a nonlimiting example, the first angle 130 is less than 180-degrees, but greater than 90-degrees. Further, the first chamfered edge 120 is offset from the second chamfered edge 122 by a second angle 132. In a nonlimiting example, the second angle 132 is less than 180-degrees, but greater than 90-degrees. In another non-limiting example, the first angle 130 and the second angle 132 can be between 175-degrees and 155-degrees. The first transition vertex 121 and the second vertex 123 can be sharp or rounded to create smooth transitions between the top surface 116 and first chamfered edge 120 and between the first chamfered edge 120 and the second chamfered edge 122 respectively.

The second chamfered edge 122 meets the bottom surface 104 at the side edge 105. The outer surface 102 can include a flat bottom surface 118 and the side edge 105 can include a convex curved portion 119 adjacent to the side edge 105. The second chamfered edge 122 can be between 5% and 40% of the chord-wise width of the blade 100, measured perpendicular to the flat top surface 116 or the flat bottom surface 118. Additionally, the second chamfered edge 122 can be arranged at a third angle 134 relative to the convex curved portion 119 of the surface of the tip 107, for example including the leading edge 110 or the trailing edge 111. The third angle 134 between the side edge 105 and the second chamfered edge 122 can be an acute angle. Alternatively, the third angle 134 can be greater than 90 degrees. In one example, the angle can be between 95-degrees and 115-degrees. Additionally, it is further contemplated that the first angle 130 and the second angle 132 are different. However, the second angle 132 and the third angle 134 could be equal or different angles. In one additional alternative example, the chamfered edges 120, 122 need not be planar, but can be radiused, such as concave or convex, or a combination of planar and radiused.

The second chamfered edge 122 can be provided along both the leading edge 110 and the trailing edge 111. In one example, the chamfered edges 120, 122 can extend around the blade 100 continuously along the leading edge 110, the tip 107, and the trailing edge 111, while it is contemplated that any of, or one or more portions of the root 108, the tip 107, the leading edge 110, and the trailing edge 111 includes the chamfered edges 120, 122. The chamfered edge 122 can meet the leading edge 110 and the trailing edge 111 at a rounded or radiused transition 151, while other transitions are contemplated.

The second chamfered edge 122 of FIG. 3 generally defines a surface which extends from the first chamfered edge 120 toward edges 110, 111. In some nonlimiting examples, as shown in FIG. 3, the second chamfered edge 122 extends to the leading edge 110, and the bottom surface 118 transitions to the leading edge 110 with the convex curved portion 119. The second chamfered edge 122 terminates at the edge 110, 111 above the bottom surface 104. The edges 110, 111 have a thickness 150 defined as the thickness between the side edge 105 and the bottom surface 104.

As shown in FIG. 3 the blade 100 has a blade thickness 140 that is less than the profile width 160. The blade thickness 140 is measured vertically from the bottom surface 118 to the top surface 116. Further, the profile width 160 is width of the blade profile, or the horizontal distance from the side edge 105 to the first transition vertex 121. It is further contemplated that the blade thickness 140 may be larger than or equal to the profile width 160.

Figure 4:
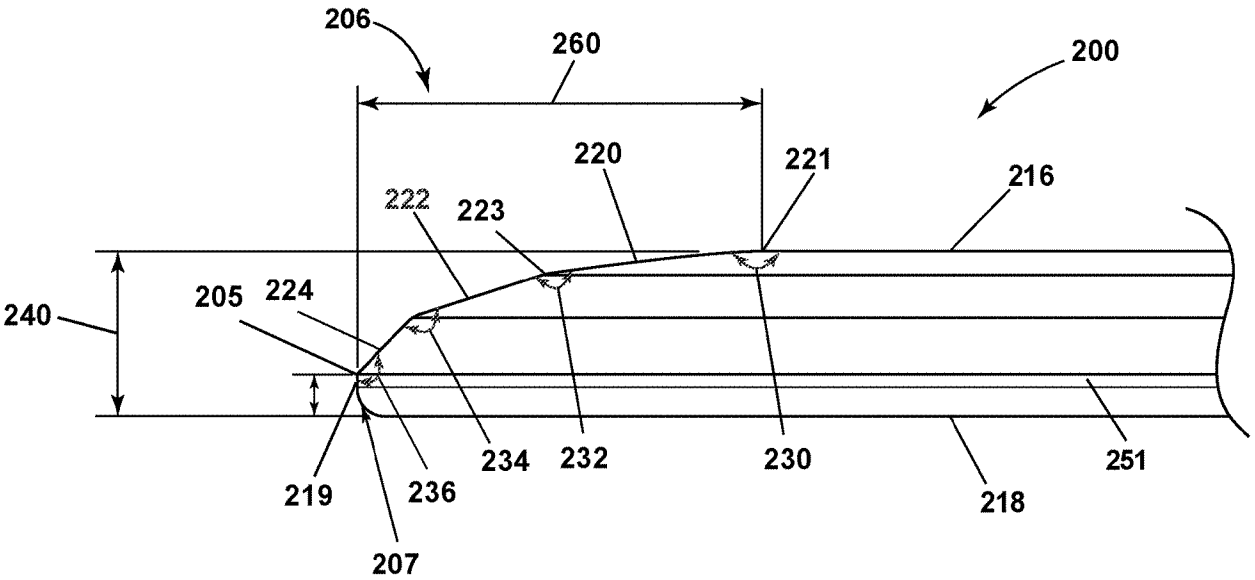
FIG. 4 is a sectional view of an exemplary blade illustrating three chamfered surfaces.

Referring to FIG. 4, another exemplary blade 200 is shown in cross-sectional profile having three transition sections. The blade 200 is similar to the blade 100; therefore, like parts will be identified with like numerals increased by 100, with it being understood that the description of the like parts of the blade 100 applies to the blade 200, unless otherwise noted.

While FIG. 3 shows two transition sections and FIG. 4 shows three transition sections, it should be understood that any number of transition sections are contemplated, such that a curved transition can be defined, where the curvature is defined by the combination of multiple planar transition sections.

The blade 200 shown in FIG. 4 is similar to blade 100 but includes three chamfered surfaces 220, 222, 224 in the transition area 206 between the top surface 216 and the bottom surface 218. The first chamfered edge 220 is adjacent the second chamfered edge 222 and extends along the side edge 205 of the blade 200. The first chamfered edge 220 defines a generally flat edge which extends from the top surface 216 to the second chamfered edge 222. The first chamfered edge 220 is offset from the second chamfered edge 222 by a first angle 230. In a nonlimiting example, the first angle 230 is an obtuse angle less than 180-degrees, but greater than 90-degrees. In one example, the angle can be between 175-degrees and 155-degrees. The meeting of the first chamfered edge 120 and the second chamfered edge 222 defines a second vertex 223. The second vertex 223 can be squared off or rounded to create transition between the first chamfered edge 120 and the second chamfered edge 222.

The second chamfered edge 222 extends along the first chamfered edge 220 and the third chamfered surface 224. The second chamfered edge 222 is arranged relative to the first chamfered edge 220 by the second angle 232 and meets the first chamfered edge 220 at a second chamfered vertex 223. The second chamfered edge 222 further extends toward the third chamfered surface 224. The second chamfered edge 222 can be arranged relative to the third chamfered surface 224 by a third angle 234.

The third chamfered surface 224 can meet the leading edge 110 and the trailing edge 111 at a flat or planar transition 251, while other transitions are contemplated. The third chamfered surface 224 is offset from the side edge 205 by a fourth angle 236. The third chamfered edge 222 can be arranged at an angle relative to the second chamfered edge 222 that is less than 180-degrees, but greater than 90-degrees. In one example, the fourth angle 236 can be between 175-degrees and 155-degrees. Additionally, the third chamfered edge 224 can be arranged at an angle relative to the planar transition 251 of leading edge 110 or the trailing edge 111. The fourth angle 236 can be greater than 90-degrees. In one example, the angle can be between 95-degrees and 115-degrees.

In one additional alternative example, the chamfered edges 220, 222, 224 can be radiused, such as concave or convex. Additionally, it is further contemplated that the third angle 234 and the fourth angle 236 are different. However, the first angle 230, the second angle 232 and the third angle 234 could be equal or different angles.

The third chamfered edge 224 is provided at both the leading edge and the trailing edge. In one example, the chamfered edges 220, 222, 224 can extend around the blade 100 continuously along the leading edge, the tip 207, and the trailing edge, while it is contemplated that any of, or one or more portions of the root 208, the tip 207, the leading edge, and the trailing edge includes the chamfered edges 220, 222, 224 The chamfered edges 222, 222 can meet the leading edge and the trailing edge at a rounded or radiused transition.

The third chamfered surface 224 of FIG. 4 generally defines a planar surface which extends from the second chamfered edge 222 toward a planar portion 219. In some nonlimiting examples, as shown in FIG. 5, the third chamfered surface 224 terminates at the planar portion 219, which transitions to a rounded or radiused transition to the flat bottom surface 218.

It is specifically contemplated that the number of chamfered surfaces can be increased. In a nonlimiting example the number of chamfered surfaces can be increased to define a generally arcuate shape extending from the bottom surface to the top surface and extending from the root 64 around the leading edge 110, tip 62, and the trailing edge 111, to the opposite side of the root 64.

As shown in FIG. 4 the blade thickness 240 is less than the profile width 260 of the blade 200. The blade thickness is measured vertically from the flat bottom surface 218 to the top surface 216. Further, the profile width 260 is the horizontal distance from the planar portion 219 to a transition vertex 221. It is further contemplated that the blade thickness 240 may be larger than or equal to the profile width 260.

The height of chamfered edges 120, 122, 220, 222, 224 discussed herein can be such that the thickness of the leading edge 110 or the trailing edge 111, or the blade itself, meets regulatory requirements. As such, the thickness between the top surface 116 and the bottom surface 118 will necessarily be thicker than that of the leading edge 110 or the trailing edge 111 having the chamfered edges 120, 122, 220, 222, 224. Furthermore, the transition vertices 121, 221 can be the minimum regulatory required rounded edge meeting the leading edge 110 or the trailing edge 111. In one example, the leading edge 110 or the trailing edge 111 can be flat, perpendicular to the top surface 116 and the bottom surface 118, with the rounded transitions connecting the leading and trailing edges 110, 111 to the top and bottom surfaces 116, 118. Alternatively, it is contemplated that the leading and trailing edge 110, 111 are wholly radiused. Alternatively, it is contemplated that the leading and trailing edge 112, 114 are wholly radiused.

The blade 100 including the chamfered edges 120, 122, 220, 222, and 224 provide for improved blade efficiency and aerodynamic performance. Such as blade 100 can require lesser energy per unit volume of air moved, thereby improving overall efficiency of the fan. Furthermore, the flat bottom surface provides for a traditional aesthetic for the fan blade that consumers find appealing. Thus, efficiency can be improved without sacrificing visual appeal of the ceiling fan or blades themselves.

The blades and sections thereof as described herein provide for both increased total flow volume for a ceiling fan, resulting in increased efficiency, while maintaining the aesthetic appearance having an unadorned bottom surface of a ceiling fan that consumers desire. More specifically, the chamfered edges 120, 122, 220, 222, and 224 provide for increased downward force on air which increases the total volume of airflow, while the flat upper and lower surfaces of the blade match traditional fan blade styles, providing a pleasing or appealing user aesthetic.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blade for a ceiling fan with a motor for driving the blade, the blade comprising:

an outer surface comprising opposing top and bottom surfaces bounded by a side edge, with a transition area connecting the top surface and the side edge;

wherein the transition area further includes:

a planar first chamfered surface adjacent the top surface and forming a first vertex with the top surface, with the first vertex forming a first angle between 90 and 180 degrees, a planar second chamfered surface adjacent the first chamfered surface and forming a second vertex with the first chamfered surface, with the second vertex forming a second angle between 90-180 degrees, and a planar third chamfered surface adjacent the second chamfered surface and the third chamfered surface forming a third vertex with the second chamfered surface, with the third vertex forming a third angle between 90-180 degrees and forming a fourth vertex with the side edge, the fourth vertex forming a fourth angle greater than 90 degrees, wherein the fourth angle is less than the third angle, the third angle is less than the second angle, and the second angle is less than the first angle.

2. The blade of claim 1 wherein the first angle, the second angle, and the third angle are all between 155 and 175 degrees.

3. The blade of claim 2 wherein the fourth angle is between 95-115 degrees.

4. The blade of claim 3 wherein the top and bottom surfaces are flat.

5. The blade of claim 4 further comprising a curved transition from the side edge to the bottom surface.

6. The blade of claim 1 wherein the third angle is an obtuse angle and the second angle is an obtuse angle.

7. The blade of claim 1 wherein the bottom surface includes a curved transition to the side edge.

8. The blade of claim 1 wherein the first side edge includes a planar portion, and the first side edge transitions to the bottom surface at a curved transition.

9. A blade for a ceiling fan, the blade comprising:

a flat upper surface;

a flat lower surface opposite from the flat upper surface;

a side edge bounding the flat lower surface; and a transition area connecting the flat upper surface to the side edge, the transition area comprising:

a planar first chamfered surface, adjacent the flat upper surface and forming a first vertex with the flat upper surface, with the first vertex forming a first angle between 90-180 degrees, and a planar second chamfered surface, adjacent the first chamfered surface and the second chamfered surface forming a second vertex with the first chamfered surface, with the second vertex forming a second angle between 90-180 degrees, wherein the second angle is a convex angle, and a third vertex with the side edge, the third vertex forming a third angle greater than 90 degrees.

10. The blade of claim 9 wherein the convex angle is an obtuse angle.

11. The blade of claim 9 wherein the third angle is less than the second angle, and the second angle is less than the first angle.

12. The blade of claim 11 wherein the first angle, the second angle, and the third angle are all between 155 and 175 degrees.

13. The blade of claim 12 wherein the fourth angle is between 95-115 degrees.

14. A blade for a ceiling fan with a motor for driving the blade, the blade comprising:

an outer surface comprising opposing top and bottom surfaces bounded by a side edge, with a transition area connecting the top surface and the side edge;

wherein the transition area further includes:

a planar first chamfered surface adjacent the top surface and forming a first vertex with the top surface, with the first vertex forming a first angle between 90 and 180 degrees, a planar second chamfered surface, adjacent the first chamfered surface and forming a second vertex with the first chamfered surface, with the second vertex forming a second angle between 90-180 degrees, wherein the second angle is equal to the first angle, and a planar third chamfered surface, adjacent the second chamfered surface and the third chamfered surface forming a third vertex with the second chamfered surface, with the third vertex forming a third angle between 90-180 degrees, and forming a fourth vertex with the side edge, the fourth vertex forming a fourth angle greater than 90 degrees.

15. A blade for a ceiling fan with a motor for driving the blade, the blade comprising:

an outer surface comprising opposing top and bottom surfaces bounded by a side edge, with a transition area connecting the top surface and the side edge;

wherein the transition area further includes:

a planar first chamfered surface adjacent the top surface and forming a first vertex with the top surface, with the first vertex forming a first angle between 90 and 180 degrees, a planar second chamfered surface, adjacent the first chamfered surface and forming a second vertex with the first chamfered surface, with the second vertex forming a second angle between 90-180 degrees, and a planar third chamfered surface, adjacent the second chamfered surface and the third chamfered surface forming a third vertex with the second chamfered surface, with the third vertex forming a third angle between 90-180 degrees, wherein the second angle and the third angle define different angles, and forming a fourth vertex with the side edge, the fourth vertex forming a fourth angle greater than 90 degrees.

* * * * *